United States Patent [19]

Brun

[11] 4,174,188

[45] Nov. 13, 1979

[54] PROCESS AND APPARATUS FOR TRANSFER OF CARGO AT SEA

[75] Inventor: Andre G. Brun, Paris, France

[73] Assignee: Compagnie Francaise des Petroles, Paris, France

[21] Appl. No.: 802,855

[22] Filed: Jun. 2, 1977

[30] Foreign Application Priority Data

Jun. 2, 1976 [FR] France ..... 7616591

[51] Int. Cl.[2] ..... B66D 1/50

[52] U.S. Cl. ..... 414/139; 52/1; 212/3; 254/93 HP; 254/172; 414/786

[58] Field of Search ..... 214/12, 13, 14, 152, 214/15 R; 212/3; 254/172, 173 R, 93 HP; 52/1

[56] References Cited

U.S. PATENT DOCUMENTS 3,662,991 5/1972 Lakiza ..... 214/14 X

FOREIGN PATENT DOCUMENTS 280862 3/1965 Australia ..... 214/15 R 2501005 1/1975 Fed. Rep. of Germany ..... 254/93 HP

*Primary Examiner*—Trygve M. Blix

*Assistant Examiner*—George F. Abraham

*Attorney, Agent, or Firm*—Sughrue, Rothwell, Mion, Zinn and Macpeak

[57] ABSTRACT

The invention is directed to a method and apparatus for considerably reducing the risks of collision between cargo and ship during transfer of the cargo at sea. For this purpose, there is created in a short interval of time a sufficient space between cargo 7 and the ship by lowering of the upper part of a support 16 at the moment $T_2$ when cable 5 lifts the cargo from the support. The invention also applies to transfer of cargo from a wharf.

7 Claims, 4 Drawing Figures

7
15
24
17
22
26
25
20
19
25
25
26
30
16
19
20
26
29
28
18
27
23
21
31
32

PROCESS AND APPARATUS FOR TRANSFER OF CARGO AT SEA

BACKGROUND OF THE INVENTION

1. Field of the Invention

The invention relates to a process of transfer of cargo at sea and particularly between a platform and ship, with the aid of a lift means such as winch, crane, travelling crane, mounted on the platform, with a fixed level or varying in very narrow limits. The invention relates further to a system for embodying this process.

2. Prior Art

Lifting of heavy or light masses on board a ship does not pose any problem when the ship is subject to movements of slight amplitude in relation to the platform or the lifting of the cargo stored on the deck is performed by means of anti-pounding devices adapted judiciously to the ship and platform.

However, the installation of devices of this type is often impossible, either because of the lack of room or because of the great level variations to which the ship can be subjected. This is particularly true in seas where the extreme level variations from wave crest to crest can reach more than twenty meters. Even without having to undergo such variations, experience has indicated that there is a danger of bumps or swinging of the lifted cargo when the wave crests follow one another at a relatively short period. Actually, there are cases when even benefiting from each crest to start the cargo lifting operation, it is not possible to lift masses on the order of a ton or more, even a meter, in a sufficiently short time to avoid a new crest lifting the ship from which the cargo was lifted and thus running the risk of a collision between the cargo suspended by its hauling cable and the deck or any part of the rigging. It is possible to consider increasing the power of the motors driving the winches used as one solution, but this would lead to unacceptable dimensions and costs.

SUMMARY OF THE INVENTION

An object of this invention is a process of transferring cargoes at sea, avoiding the collision of the cargo, lifted from the ship and suspended on a cable operated by an outside station, with the ship during the arrival of a wave. In this process, a space is created between the cargo and the ship by rapid lowering of the initial support of the cargo during lifting of the latter.

Thus, while conforming to the usual methods of taking hold of a mass on the deck of a ship from a platform whereby the hauling motor was operated after hooking of the cargo and as soon as the ship was carried by the crest of a wave, the mass is made to rest on a support, preferably previously in the raised position in relation to the base on which it rests, and immediately the support is brought to the low position as soon as lifting of the cargo begins, the recall of the support being triggered either manually or automatically by the lifting of the cargo.

This process thus makes it possible to separate the cargo a predetermined distance from the level of the wave crest that has lifted the ship at the moment of starting so that, in case the level of the second wave exceeds the level of the first, by a height even equal to the travel of the support, the cargo is already pulled above the level of the low position of the support during the second crest, avoiding any type of contact between the ship and cargo.

Another advantage of the process is to make it possible, given a motor of given power, to avoid using the motor at its maximum power because of the additional distance between the sea and the cargo, this distance being created by the differences in the levels of the low and high positions of the support. Also, it is possible to take advantage of this distance to lift heavier cargo by reducing the upward speed of the cargo.

Another object of the invention is to avoid or considerably reduce the collisions by using such a process, without having to make the instant of the start of lifting the cargo coincide with that when the ship is lifted by the wave crest.

For purposes of comparison, let it be assumed that a conventional lifting technique is employed. If the usual upward speed of cranes is assumed to be on the order of 1.2 m/sec. it is necessary, to avoid the impact of any part of the ship in ascending movement due to pounding, that the ratio of the height of the pounding at the half-period of the wave be less than 1.2 m/sec. Statistical studies have shown that the risk of collision is high since, to avoid collision in the case of waves of 3–6 meters, the average period of the swell should be greater than the value between $2\times(6/1.2)=10$ sec. and $2\times(3/1.2)=5$ sec. and that this condition is realized only for 15% to 80% of the waves. On the other hand, if the process defined above is used and the plate is carried by an elevator able to descend from a chosen height at speed v, it can be seen that the above ratio diminishes and that, even for a slower speed, periods of the swell are reached that must be only greater than 7 and 4 sec., which is the case of 50% to 90% of the waves. Thus, according to the process of this invention, a sufficiently rapid distance is created between the cargo and support so as not to be subject to the passage of the crests, while avoiding impact with any part of the ship.

Another object of the invention is an apparatus for embodying this process, comprising at least a means supporting a plate on which the cargo is made to rest and a means causing the rapid drop of the means supporting the plate.

Another object of the invention is an apparatus of this type, wherein the means supporting the plate is made up of a bag or inflatable bellows, or an articulated system operated by a jack.

This embodiment has the advantage of making possible a rapid placement of the plate in its two positions: low and high. It further has the advantage of being small, even for large masses, and being able to be used conveniently.

Another object of the invention is an apparatus of this type further comprising a lower plate supporting the bag, the bellows or any other carrying means such as a jack, this plate being connected to the cargo carrying plate by an articulated system so that said plates assure the protection of any carrying means: bag, bellows or jacks, in the working or rest positions.

The apparatus can easily be associated with similar identical apparatus to constitute a unit able to support masses of the most varied weight and size, masses with large horizontal surfaces being able to be supported, for example, by a unit of two or three apparatus or even more, depending on needs. Such apparatus being of small size can be easily stacked and comprise all desired accessories: pressure indicators, adjustable valves for rapid evacuation of the inflating fluid, locking device and in a general way comprise all secondary equipment compatible with the process stated.

Another object of the invention is an apparatus for embodying the process defined above and according to which the cargo is lifted by any elevator to any desired height and according to which the descent of the elevator is controlled at the time of takeoff of the cargo, the descent speed being faster as the variation of level of the load by the elevator is greater.

Other objects and characteristics of the invention will become apparent from the following description given with reference to the accompanying drawings which represent, by way of non-limiting example, an embodiment of the process of lifting cargo at sea by previously increasing their distance from the water level perpendicular to the cargo.

DESCRIPTION OF THE PREFERRED EMBODIMENT

Figure 1:
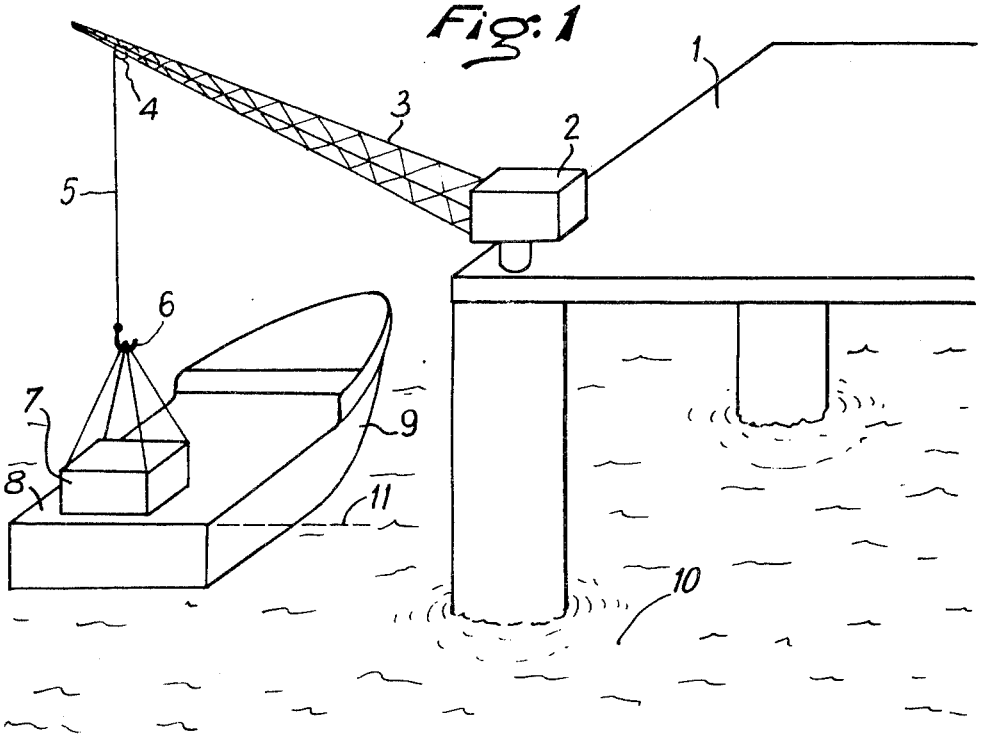
FIG. 1 is a schematic representation of a platform illustrating an operation of lifting cargo on board a ship without using the process of the invention.

Referring now to FIG. 1, platform 1, comprises any lifting means schematized by control station 2 and arm 3 supporting pulley 4 around which passes hauling cable 5. This cable is hooked by any means 6 to cargo 7 resting, for example, on deck 8 of a ship 9. As shown in FIG. 1, cable 5 is drawn to bring the cargo onto platform 1.

If level 10 of the sea corresponds to that of the crest of a wave, the most favorable case for permitting cargo 7 to be sufficiently distant from deck 8 at the time of passage of the following wave crest is present. However, it can be seen that, even in this case, there would still be a risk of collision between cargo 7, insufficiently lifted during the relatively short time span between two successive crests, and the deck or part of the ship's rigging, when the level of the second wave is greater than the level of the first.

Figure 2:
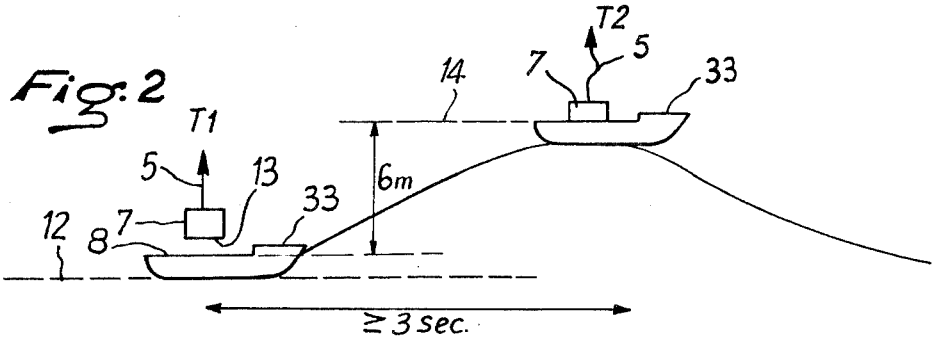
FIG. 2 represents as a function of time, the positions of the ship and cargo during lifting.

The risk of collision appears still more clearly in FIG. 2 where it is assumed that cable 5, holding cargo 7, was pulled at the moment when level 10 of the wave was that of a trough or that this level would continue to drop to reach the lowest point at 12. Assuming now, that the difference in level between crest 12 and the following crest is 6 m, it is clear, under these conditions, that the collision would occur at instant $T_2$ or even before if cargo 7 is lifted at its normal speed of 1.2 m/sec. Hence, if the half-period of the swell is less than 4 seconds for example, the time necessary for cargo 7 to travel 4.80 meters is insufficient, if the distance between deck 8 and lower part 13 of cargo 7 is equal to 1.2 m at instant $T_2$. Such an eventuality can occur since the half-period of the swell can drop to 3 seconds, as indicated in FIG. 2.

This risk is increased more when deck 8 does not coincide, during passage of the crest, with horizontal level 14, the ship being able to undergo, besides the pounding movement, movements of pitching and rolling able to cause collision of bottom 13 of the cargo with the rigging or rails 33, even if the half-period between crests is greater than 4 seconds or the variation in level is less than 6 meters.

Figure 3:
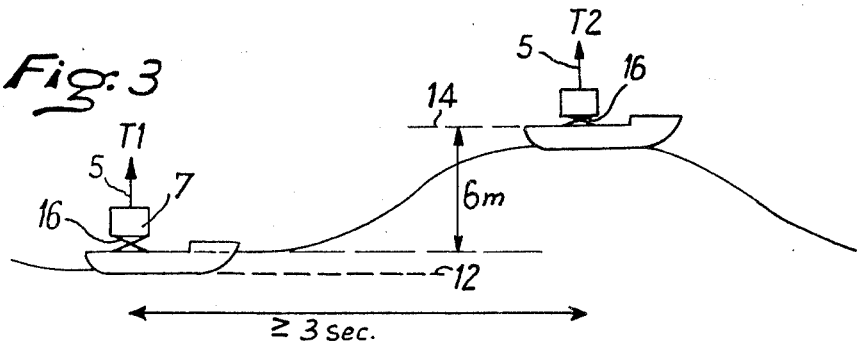
FIG. 3 is a representation of the positions of the ship and cargo before and after its lifting by using an apparatus embodying the process, object of the invention.
Figure 4:
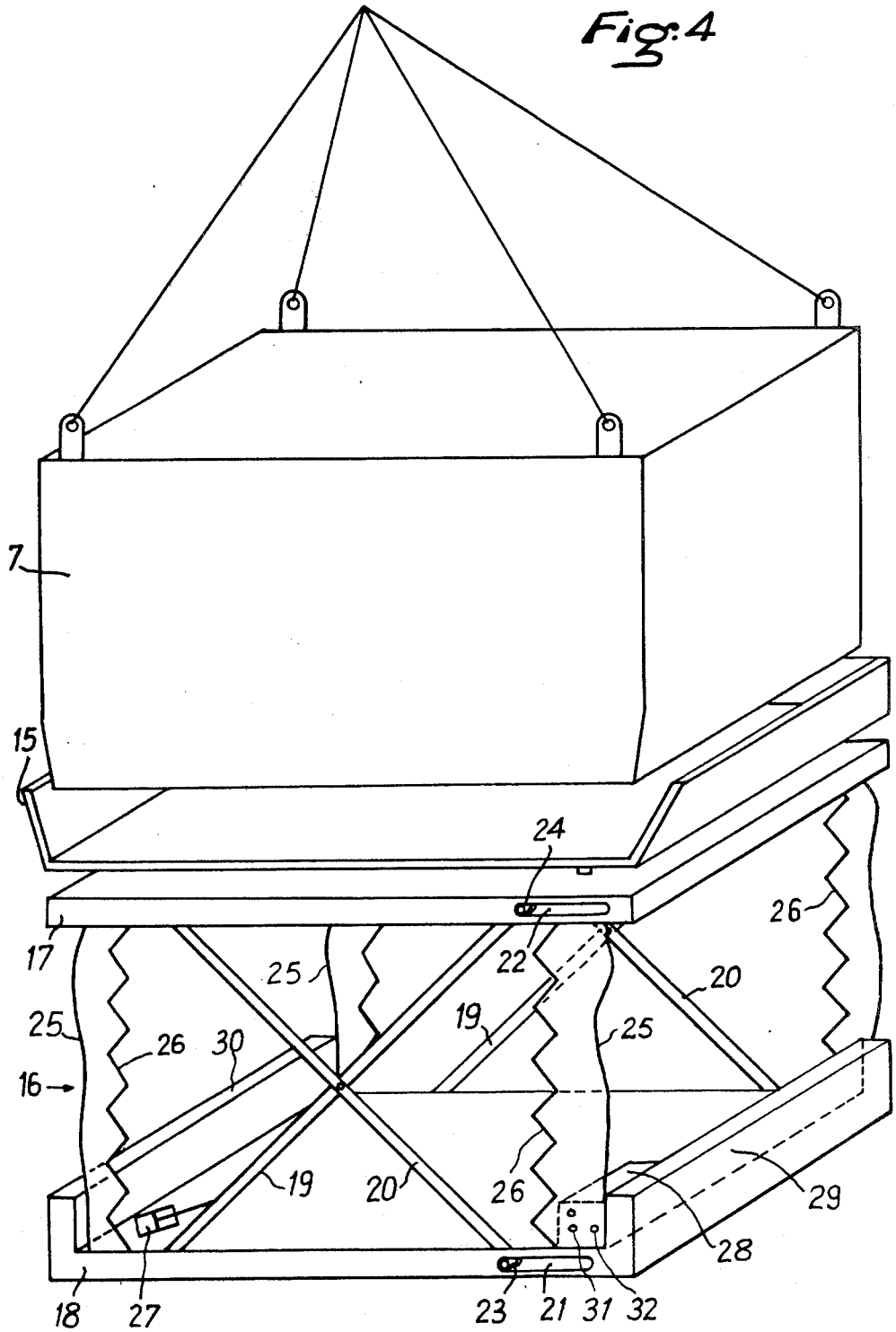
FIG. 4 is a schematic view in elevation of an apparatus for embodying the process.

To eliminate or reduce these risks, according to the invention, cargo 7 is lifted, FIG. 3, either by means of an elevator able to descend at a sufficient speed to avoid its own collision with the cargo or by means of an aparatus 16 that can be seen better in FIG. 4.

Referring now to FIG. 4 the main embodiments of the apparatus are shown in schematic form with a bag by lines 25, bellows by jagged lines 26 and a jack operating an articulated system 19, 20. It is understood that it suffices to use one or other of these three equivalent means to keep the upper plate 17 separated from lower plate 18. To make the drawing more clear, it has been assumed that jack 27 had separated plate 17 by a simple traction exerted on arm 19 pivoting on plate 18, a pin 24, fastened to the upper end of arm 19, sliding in a slot 22 of upper plate 17 and that arm 20, pivoting on plate 17, had brought pin 23 toward the left of slot 21. It is clear that this articulated system is designed so that conversely, release of the traction exerted by jack 27, actually the thrust exerted by this jack on arm 19, brings pins 23 and 24 toward the right of slots 21 and 22. Actually, these slots have a much larger clearance to bring plate 17 on upper edges 30 of side edges 29. In this Figure, 28 represents the control of the means used for lifting plate 17. By its manual control, it operates the inflation or deflation of bag 25, or bellows 26 or the traction or thrust of jack 27. It will be noted that in each of these cases, it suffices to control either a delivery of fluid under pressure, or a simple release of the pressure of the circuits, the input and output circuits of the fluid used being schematized as 31 and 32. Further, control 28 and the unit that it controls can only be designed to raise plate 17 in the absence of cargo and keep it in position after loading. The bag 25 or bellows 26 can be inflated with air.

Plate 18 can be fastened on the deck and plate 17 provided with a pallet 15 facilitating placing and holding of cargo 7. The control 28 can be remotely controlled from station 2.

Referring again to the example shown in FIG. 2, where the cargo 7 was lifted before the ship reached trough 12 of the wave, and assuming that the lifting was performed at the very moment but after having placed cargo 7 on a device 16, as in the example shown in FIG. 3, it is clear, under these conditions, that cargo 7 should be represented above the position shown and the risk of collison is considerably reduced. The cargo 7 has to be lifted, for example, no more than 3.60 m instead of 4.80 m in the preceding example.

It is clear that the risk of collision would be zero if the start of the lifting of the cargo occurred at the precise instant of the passage of the first crest, deck 8 of the ship being at level 14, and if the second crest reached the same level as the preceding one. But, assuming that as a result of a false maneuver, the case of FIG. 3 with cargo 7 resting on device 16 results. It then suffices, to avoid any risk of collision, to wait for the next passage of the crest at $T_2$ and at this moment to trigger, besides the traction of cable 5, the drop of upper plate 17 of apparatus 16, this drop being controlled manually. This case, not shown at $T_2$, would allow cargo 7 to be the same distance in relation to the deck as that shown at $T_1$ where the device 16 had not been brought back to the low position.

It will be noted that in the most unfavorable case where the exact instant of the highest level of the wave would not be detected because the level of the crest would be greater than that of the preceding crest, the sudden dropping of plate 17 would compensate at least for the increase of the level of the wave crest and would avoid any impact as shown at $T_2$.

Thus regardless of the case considered, outside of that of operating without any risk of collision by coincidence of the lifting of the cargo and the passage of the crest, the use of the process, makes it possible to systematically escape the risk of collision provided that the height of the drop of plate 17 is sufficient and makes it possible, in the most unfavorable cases where the height of the drop of the apparatus is slight in relation to the variations of the levels of the crests, to reduce the frequency of collisions considerably.

The invention can be applied in the same way to loading of ships and particularly tenders. The cargoes can, for example, be slid from the wharf onto the plate of an elevator on board and brought to the high position at the passage of a crest, the elevator then dropping the cargo for putting it in place.

An elevator of any type can be installed instead of apparatus 16 in case of transfer at sea, the elevator being brought to the low position at a speed at least equal to 0.50 meter per second for waves greater than 3 meters to increase the distance necessary for practical elimination of any collision. Obviously, this distance could be increased by superposition of an apparatus described and an elevator, the increase of the distance and the rapidity of the creation of this space making it possible to increase the tolerance relative to the determination of the instant for control of the traction exerted on the cargo.

What is claimed is:

1. A process of transferring cargo from a ship at sea which is rising and falling by hoisting means mounted on a relatively stable platform comprising placing the cargo on a vertically moveable support, located on said ship raising said support relative to said ship, lifting the cargo from said support by means of a cable controlled by said hoist means when said ship reaches its highest point on the crest of the wave and immediately and rapidly lowering said support relative to said ship to quickly increase the spacing between said cargo and said support.

2. A process as set forth in claim 1, wherein the lowering of said support is controlled by the lifting of the cargo.

3. A process as set forth in claim 2, wherein said support is lowered at a speed of 0.5 meters per second for waves greater than 3 meters.

4. Apparatus for assisting in the transfer of cargo from a ship at sea which is rising and falling by hoisting means on a relatively stable platform comprising a first support plate located on said ship for receiving cargo thereon, fluid operable adjustable support means for raising said first support plate to a predetermined height above said ship and means for rapidly lowering said support plate upon lifting of said cargo from said first support plate, said means for accomplishing the rapid lowering of said first support plate beng comprised of control means which permit the rapid evacuation of fluid from said fluid operable means upon lifting of cargo from said first support plate.

5. Apparatus as set forth in claim 4, further comprising a second support plate disposed directly on said ship and upon which said support means is mounted.

6. Apparatus as set forth in claim 5, wherein said two support plates are interconnected by means of an articulated system.

7. Apparatus as set forth in claim 5, further comprising shoulder means on at least one of said support plates for limiting the approach of said two plates toward each other.

* * * * *